US011127251B1

(12) United States Patent
Chang

(10) Patent No.: US 11,127,251 B1
(45) Date of Patent: Sep. 21, 2021

(54) INDUCTION CARD MANAGING DEVICE FOR A GAMING MACHINE

(71) Applicant: Top Vending Machine Electronics Co., Ltd., Taoyuan (TW)

(72) Inventor: Yuan-Fong Chang, Taoyuan (TW)

(73) Assignee: Top Vending Machine Electronics Co., Ltd., Taoyuan (TW)

( * ) Notice: Subject to any disclaimer, the term of this patent is extended or adjusted under 35 U.S.C. 154(b) by 10 days.

(21) Appl. No.: 16/822,281

(22) Filed: Mar. 18, 2020

(51) Int. Cl.
*G07F 17/32* (2006.01)

(52) U.S. Cl.
CPC ..... *G07F 17/3239* (2013.01); *G07F 17/3209* (2013.01)

(58) Field of Classification Search
CPC ..... G07F 17/3239; G07F 17/3209
See application file for complete search history.

(56) References Cited

U.S. PATENT DOCUMENTS 7,247,098 B1 * 7/2007 Bradford ..... G07F 17/3202 463/47
2014/0080578 A1 * 3/2014 Nguyen ..... G07F 17/3237 463/25
2014/0090953 A1 * 4/2014 Johnson ..... G07F 19/205 194/344

* cited by examiner

*Primary Examiner* — Werner G Garner
(74) *Attorney, Agent, or Firm* — Karin L. Williams; Alan D. Kamrath; Mayer & Williams PC

(57) ABSTRACT

An induction card managing device for a gaming machine includes a housing unit having a front housing, a connection seat, and a rear housing. The front housing includes a top side having a card slot. Two guiding plates extend forwards from the connection seat into the front housing and form a card passage therebetween. An induction card can be inserted downwards through the card slot into the card passage and is positioned by a bottom plate between the two guiding plates. The control device is mounted in the housing unit and includes a controller, a sensor, a display, and an inputting device. The display and the inputting device are received in a through-slot and openings in the front housing, respectively. The sensor is received in the rear chamber, is aligned with the card passage of the connection seat, and can proceed with reading/writing on the induction card.

10 Claims, 11 Drawing Sheets

INDUCTION CARD MANAGING DEVICE FOR A GAMING MACHINE

BACKGROUND OF THE INVENTION

The present invention relates to a card managing device for a gaming machine and, more particularly, to an induction card managing device mounted on a gaming machine to reduce a credit value of a card before permission of playing the gaming machine.

A common payment method for a player playing a game of a gaming machine is insert coins or a bill into a coin receiver or a bill receiver on the gaming machine, so as to obtain permission to play the game. The player has to troublesomely prepare coins or bills acceptable by the coin receiver or the bill receiver of the gaming machine, and much more inconvenience is caused when a large quantity of coins or bills is required. Furthermore, a manager of the gaming machine has to periodically recycle the coins and the bills received by the gaming machine, which is laborious, is difficult to obtain the business information, and is, therefore, disadvantageous to monitoring and management of the whole amusement arcade. Improvement is, thus, required.

BRIEF SUMMARY OF THE INVENTION

An objective of the present invention is to provide an induction card managing device mounted on a gaming machine permitting a user to use the gaming machine by reducing a credit value of an induction card, avoiding inconvenience in exchanging and inserting coins. Furthermore, a manager of the gaming machine can simply and immediately obtain the status information of the induction card.

Another objective of the present invention is to provide an induction card managing device including a card passage defined by a front housing and a connection seat and a sensor mounted in a rear housing, such that the induction card managing device is suitable for an induction card.

A further objective of the present invention is to provide an induction card managing device including an annular fixing board fixed in an opening resultant from removal of a coin receiver or a bill receiver originally mounted to a gaming machine, avoiding inconvenience in installation.

An induction card managing device for a gaming machine according to the present invention includes a housing unit and a control device. The housing unit includes a front housing, a connection seat, and a rear housing. The front housing includes a front chamber having an opening facing rearwards. The rear housing includes a rear chamber having an opening facing forwards. The connection seat is coupled to the front housing, covers a rear side of the front chamber, and extends uprightly. The rear housing is securely fixed to a rear side of the connection seat. The front housing includes a front side having a through-slot and a plurality of openings. The front housing includes a top side having a card slot. The connection seat includes a front side having left and right portions. Two guiding plates respectively extend forwards from the left and right portions of the front side of the connection seat into the front chamber to form a card passage between the two guiding plates. A bottom plate is disposed between the two guiding plates. An induction card is permitted to be inserted downwards through the card slot into the card passage and is stopped and positioned by the bottom plate. The control device is mounted in the housing unit. The control device includes a controller, a sensor, a display, and an inputting device. The sensor, the display, and the inputting device are electrically connected to the controller. The display and the inputting device are located in the front chamber and are received in the through-slot and the plurality of openings, respectively. The sensor is received in the rear chamber, extends uprightly, and is aligned with the card passage of the connection seat. The sensor is configured to proceed with reading/writing on the induction card.

In an example, the controller includes a control circuit board securely mounted in the rear chamber of the rear housing and extending uprightly. The sensor is mounted on an upper section of a front side of the control circuit board. The control circuit board further includes a wireless communication device below the sensor. The wireless communication device is comprised of an antenna and an RFID integrated circuit.

In an example, the connection seat includes a slot, and the antenna extends forwards through the slot into the front chamber and is positioned in the slot.

In an example, the controller further includes a setup device and a plurality of connectors. The setup device and the plurality of connectors are disposed on a rear side of the control circuit board. The rear housing includes a rear side having a plurality of through-holes. The setup device and the plurality of connectors are exposed via the plurality of through-holes of the rear housing.

In an example, the front housing includes two light chambers on left and right sides of the card slot, respectively. Two lighting elements are respectively received in the two light chambers.

In an example, each of the two guiding plates includes a front end having an inner plate. At least one front plate extends forwards from the front side of the connection seat. The inner plates of the two guiding plates guide a front side of the induction card. The at least one front plate guides a rear side of the induction card.

In an example, the housing unit further includes an annular fixing board on the rear side of the rear housing, and the annular fixing board includes a plurality of fixing holes.

In an example, the front housing, the connection seat, and the rear housing are coupled in sequence. The front housing includes a plurality of first engaging holes disposed in a periphery of the rear side of the front housing. The connection seat includes a plurality of first coupling members coupled with the plurality of first engaging holes, respectively, securing the front housing and the connection seat together.

In an example, the connection seat includes two second engaging holes on left and right portions of the rear side of the connection seat, respectively. The rear housing includes two second coupling members on left and right sides thereof. The two second coupling members are coupled with the two second engaging holes to secure the rear housing and the connection seat together.

In an example, the connection seat includes a plurality of recesses disposed on upper and lower ends of the rear side of the connection seat. The rear housing includes a plurality of protrusions on upper and lower sides of the rear housing. The plurality of protrusions is coupled with the plurality of recesses to provide a positioning effect.

The present invention will become clearer in light of the following detailed description of illustrative embodiments of this invention described in connection with the drawings.

DETAILED DESCRIPTION OF THE INVENTION

Figure 1:
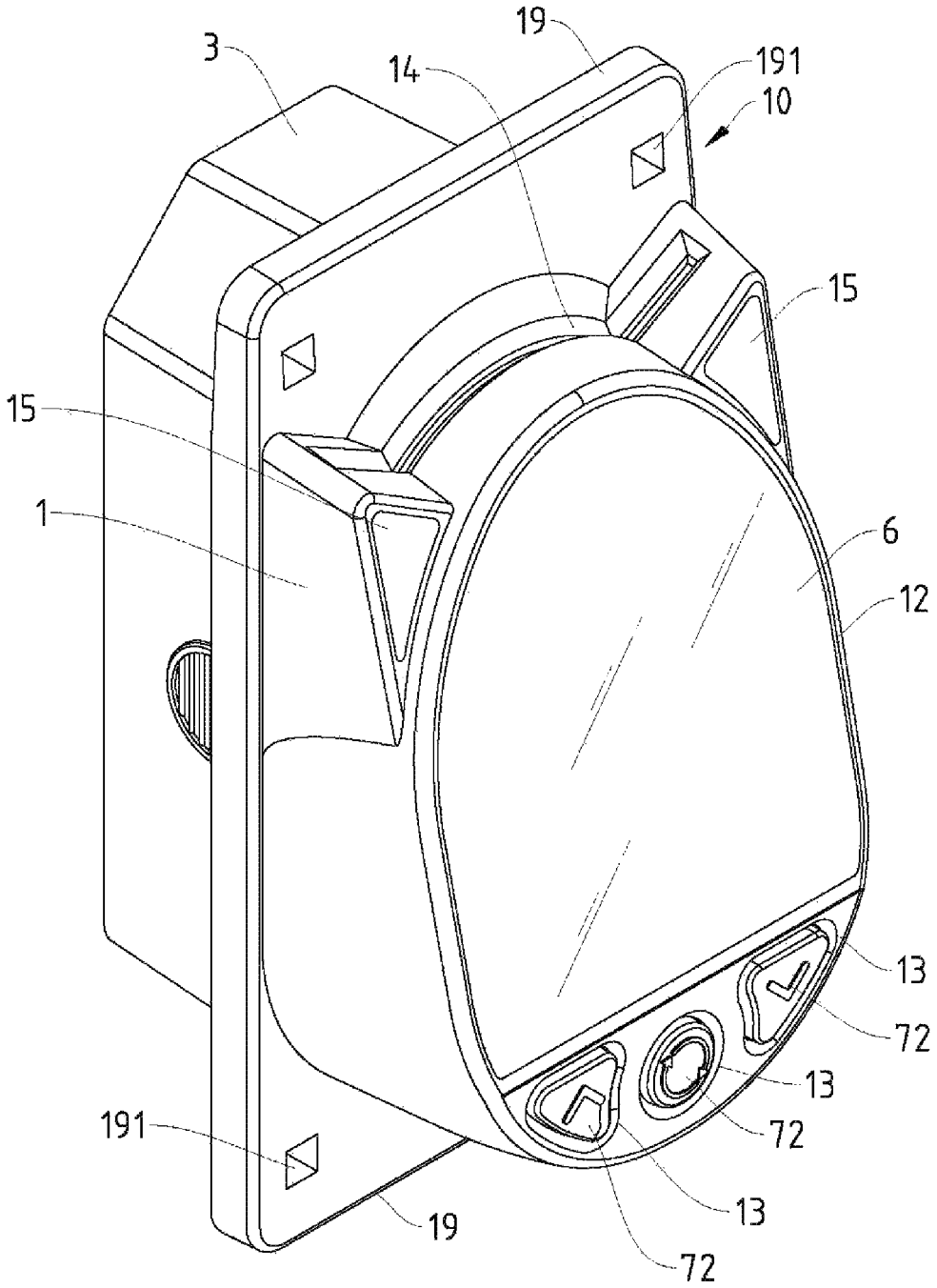
FIG. 1 is a perspective view of an induction card managing device for a gaming machine of an embodiment according to the present invention.
Figure 2:
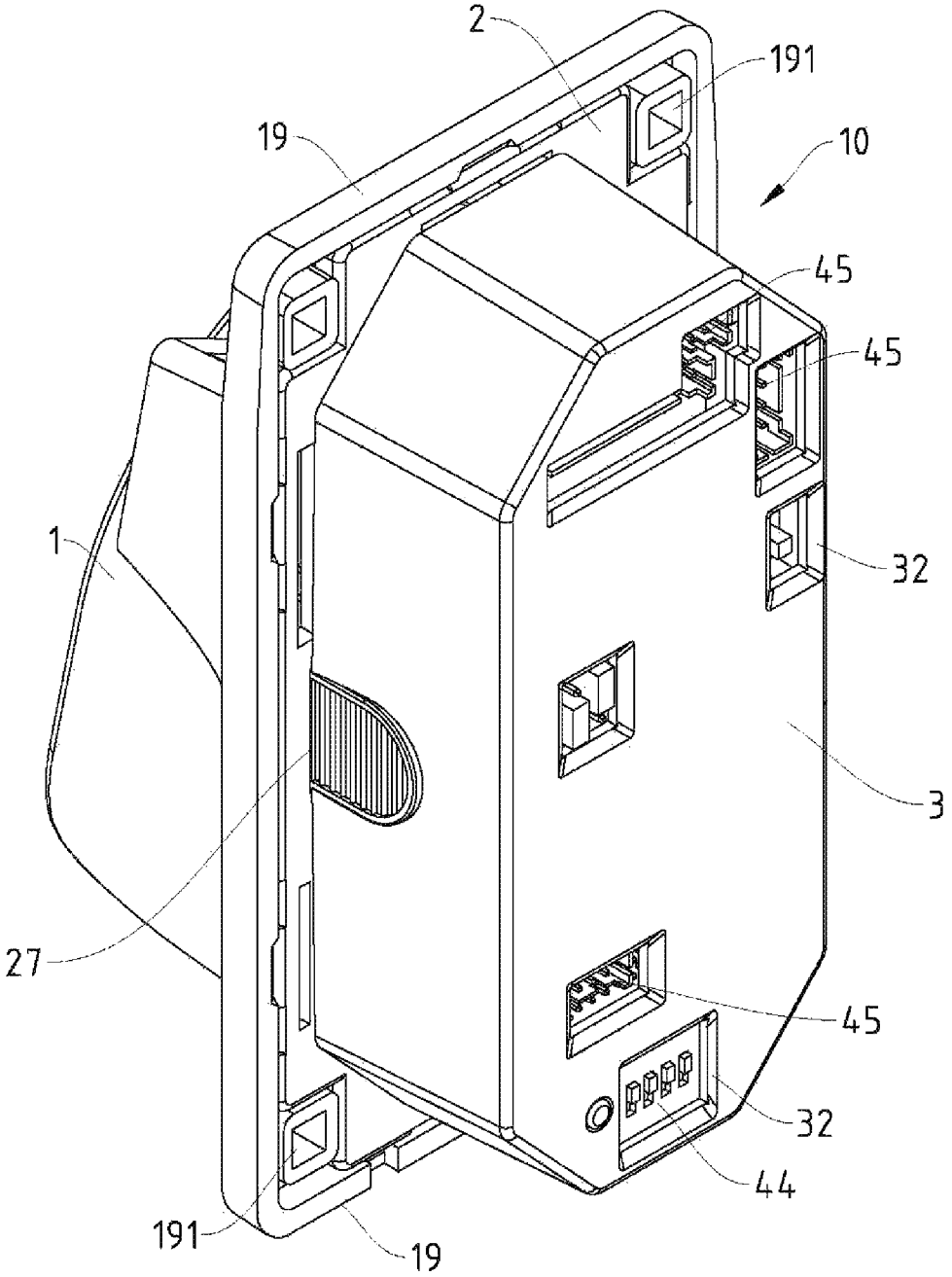
FIG. 2 is another perspective view of the induction card managing device of FIG. 1.
Figure 3:
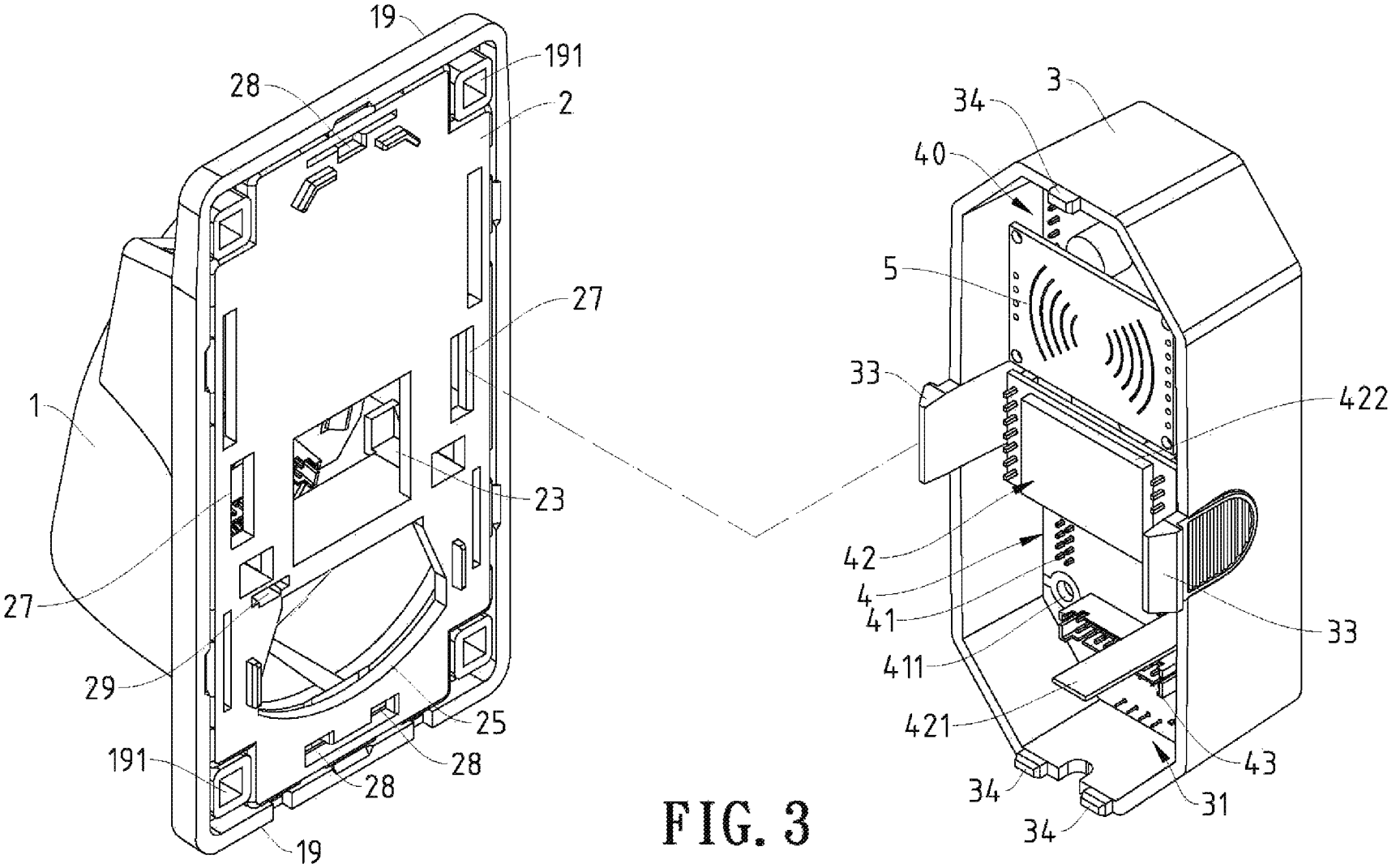
FIG. 3 is an exploded, perspective view illustrating a housing unit of the induction card managing device of FIG. 1.

With reference to FIGS. 1-7, an induction card managing device for a gaming machine of an embodiment according to the present invention comprises a housing unit 10 and a control device 40. The housing unit 10 includes a front housing 1, a connection seat 2, and a rear housing 3. The front housing 1, the connection seat 2, and the rear housing 3 are coupled in sequence. The front housing 1 includes a front chamber 11 having an opening facing rearwards. The rear housing 3 includes a rear chamber 31 having an opening facing forwards. The connection seat 2 is coupled to the front housing 1, covers a rear side of the front chamber 11, and extends uprightly. The connection seat 2 includes a through-slot 25 and a slot 29 (see FIGS. 3 and 5).

The rear housing 3 is securely fixed to a rear side of the connection seat 2. The rear housing 3 includes a rear side having a plurality of through-holes 32. The front housing 1 includes a front side having a through-slot 12 and a plurality of openings 13. The front housing 1 includes a top side having a card slot 14. The front housing 1 includes two light chambers 15 on left and right sides of the card slot 14, respectively. Two lighting elements 16 are respectively received in the two light chambers 15 (see FIG. 6).

Figure 10:
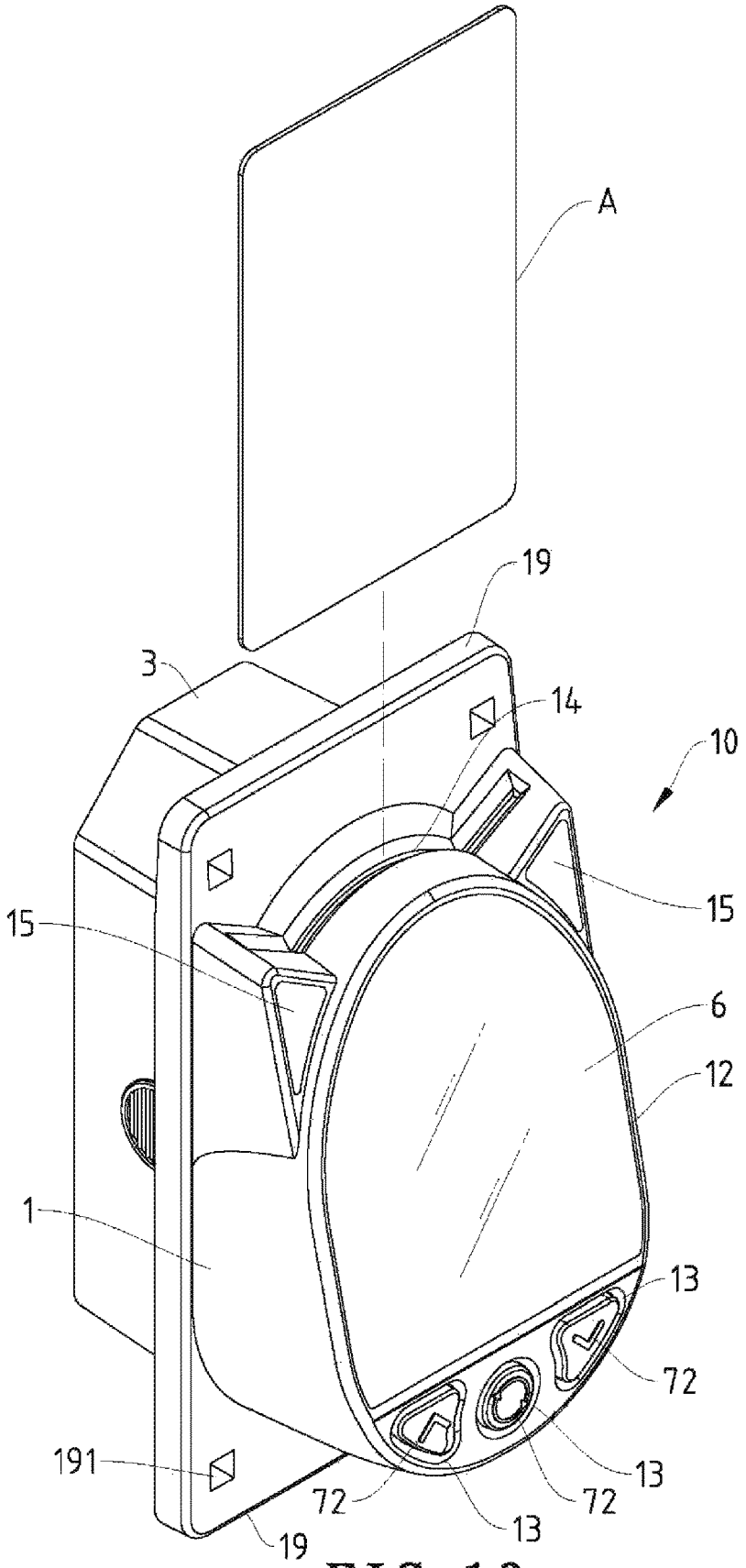
FIG. 10 is a diagrammatic perspective view illustrating use of the induction card managing device of FIG. 1.
Figure 11:
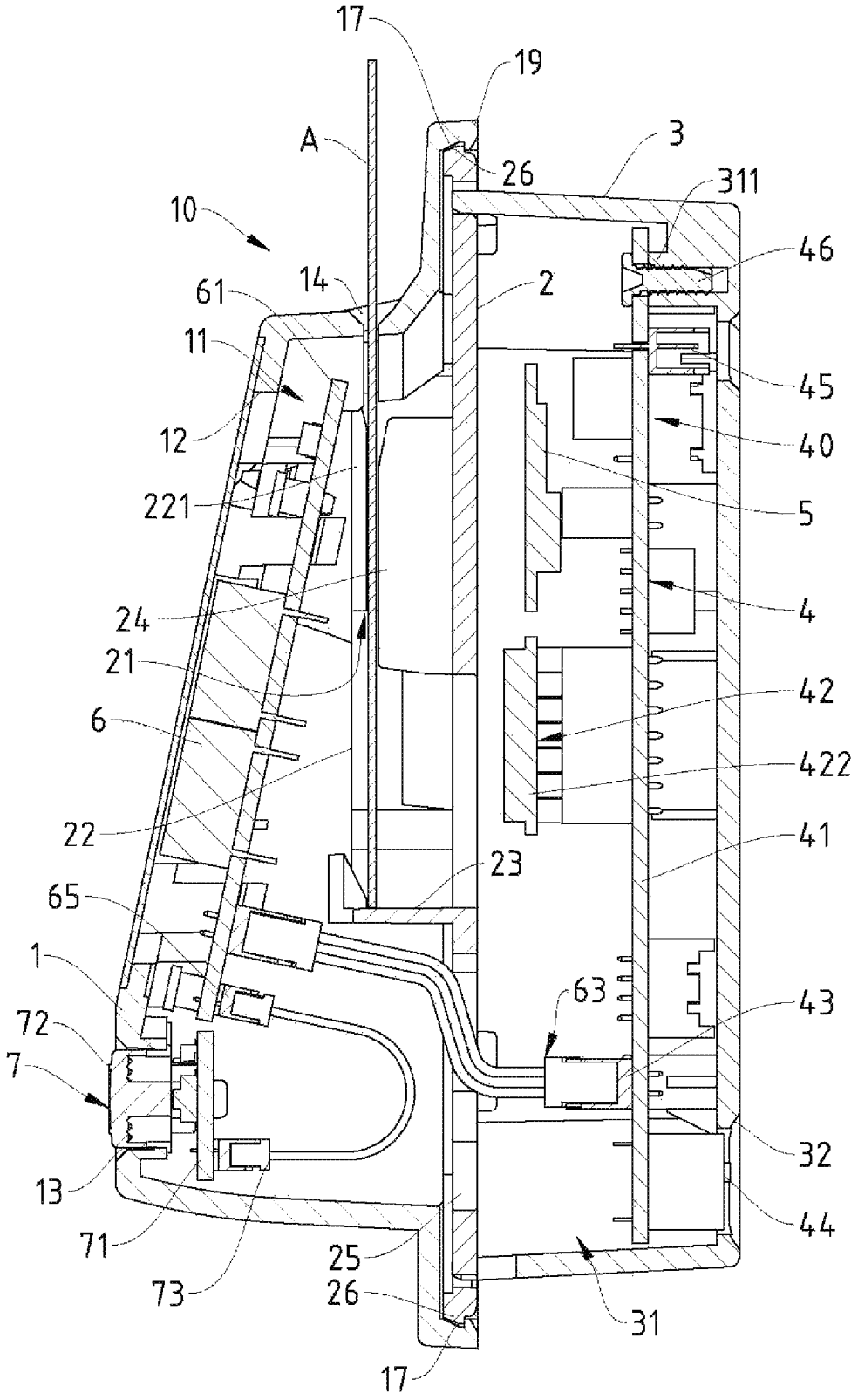
FIG. 11 is a cross sectional view of the induction card managing device of FIG. 1 with a card inserted into the induction card managing device.

The connection seat 2 includes a front side having left and right portions. Two guiding plates 22 respectively extend from the left and right portions of the front side of the connection seat 2 into the front chamber 11 to form a card passage 21 between the two guiding plates 22. A bottom plate 23 is disposed between the two guiding plates 22. Each of the two guiding plates 22 includes a front end having an inner plate 221. At least one front plate 24 extends forwards from the front side of the connection seat 2. The inner plates 221 of the two guiding plates 22 guide a front side of the induction card A, and the at least one front plate 24 guides a rear side of the induction card A, as shown in FIGS. 10 and 11. Thus, the induction card A can be inserted downwards through the card slot 14 into the card passage 21 and is stopped and positioned by the bottom plate 23. The housing unit 10 further includes an annular fixing board 19 on the rear side of the rear housing 1. The annular fixing board 19 includes a plurality of fixing holes 191.

The front housing 1 includes a plurality of first engaging holes 17 disposed in a periphery of the rear side of the front housing 1. The connection seat 2 includes a plurality of first coupling members 26 coupled with the plurality of first engaging holes 17, respectively, securing the front housing 1 and the connection seat 2 together. The connection seat 2 includes two second engaging holes 27 on left and right portions of the rear side of the connection seat 2, respectively. The rear housing 3 includes two second coupling members 33 on left and right sides thereof. The two second coupling members 33 are coupled with the two second engaging holes 27 to secure the rear housing 3 and the connection seat 2 together. The connection seat 2 includes a plurality of recesses 28 disposed on upper and lower ends of the rear side of the connection seat 2. The rear housing 3 includes a plurality of protrusions 34 on upper and lower sides of the rear housing 3. The plurality of protrusions 34 is coupled with the plurality of recesses 28 to provide a positioning effect.

The control device 40 is mounted in the housing unit 10. As shown in FIGS. 3-9, the control device 40 includes a controller 4, a sensor 5, a display 6, and an inputting device 7. The sensor 5, the display 6, and the inputting device 7 are electrically connected to the controller 4. The controller 4 includes a control circuit board 41 securely mounted in the rear chamber 31 of the rear housing 3 and extending uprightly. Screws 46 extend through through-holes 411 of the control circuit board 41 and are secured to pegs 311 on the rear housing 3 (see FIGS. 7 and 9). The sensor 5 is mounted on an upper section of a front side of the control circuit board 41. The control circuit board 41 further includes a wireless communication device 42 below the sensor 5. The wireless communication device 42 is comprised of an antenna 421 and an RFID (radio frequency identification) integrated circuit 422. The antenna 421 extends forwards through the slot 29 into the front chamber 31 and is positioned in the slot 29. The antenna 421 extending into the front chamber 31 is advantageous to emission of signals. The controller 4 further includes a setup device 44 and a plurality of connectors 45. The setup device 44 and the plurality of connectors 45 are disposed on a rear side of the control circuit board 41. The setup device 44 and the plurality of connectors 45 are exposed via the plurality of through-holes 32 of the rear housing 3.

Figure 4:
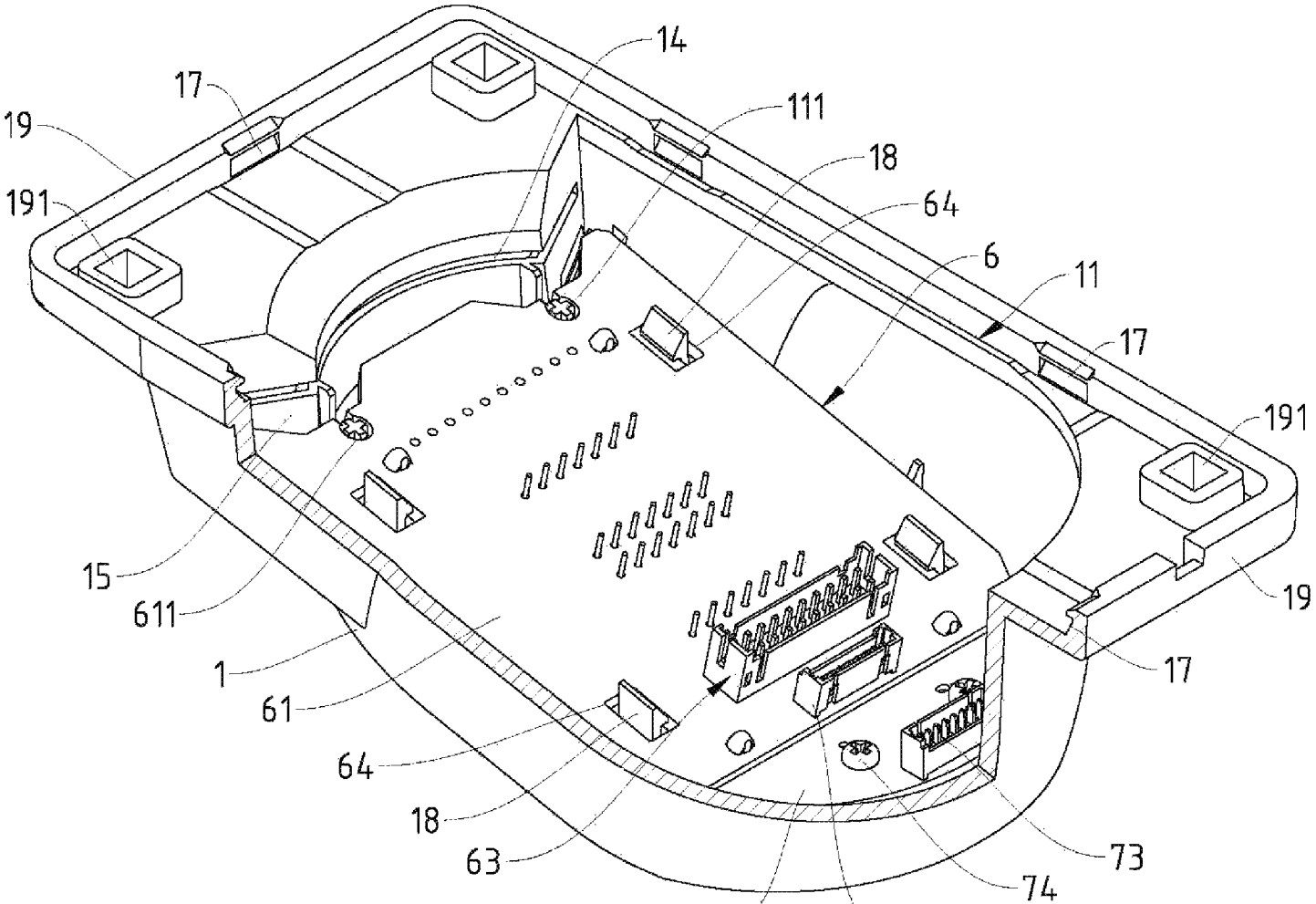
FIG. 4 is an exploded, perspective of a front housing of the housing unit.
Figure 5:
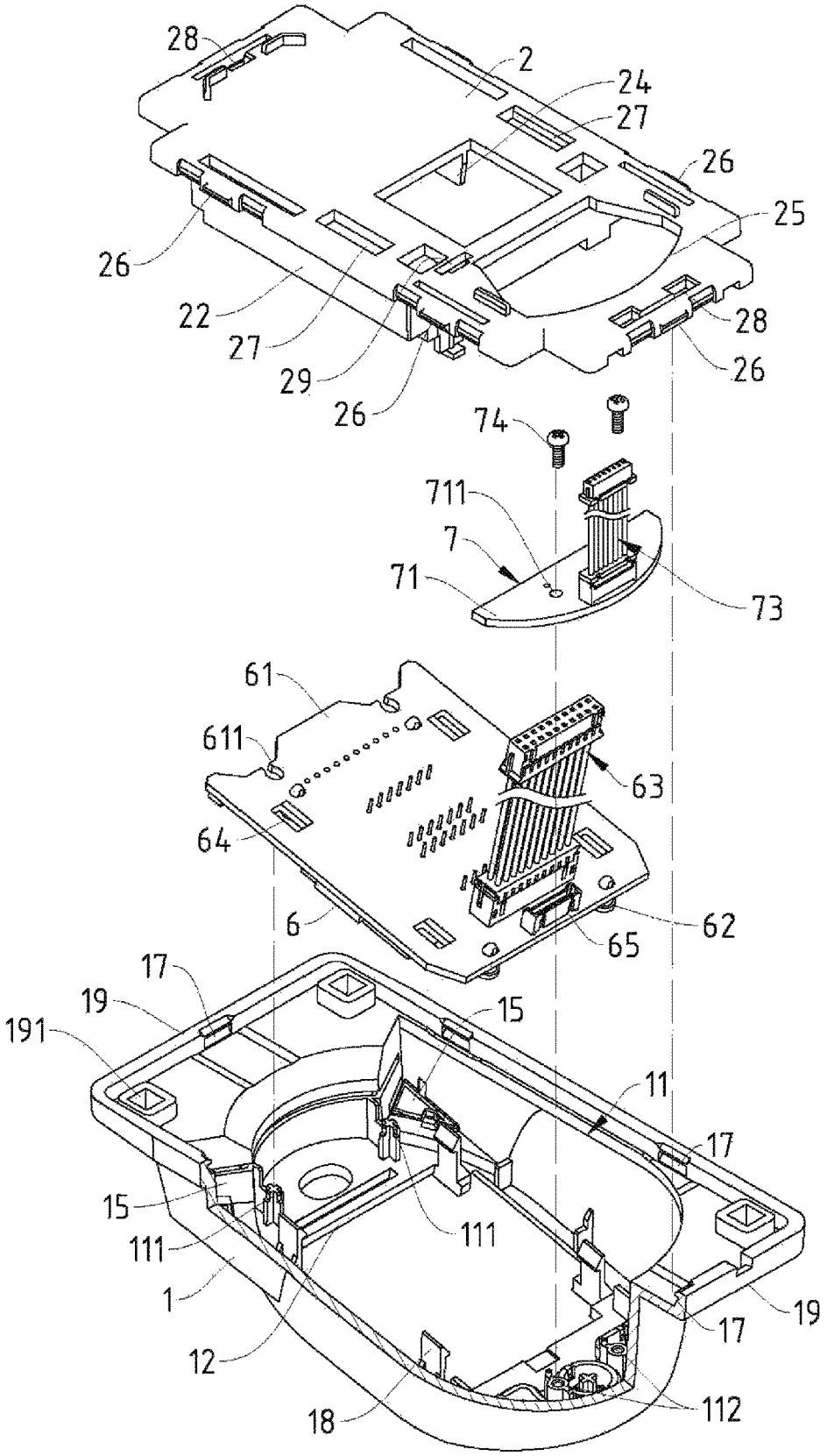
FIG. 5 is an exploded, perspective view illustrating the front housing, a display, an inputting device, and a connection seat of the induction card managing device of FIG. 1.
Figure 6:
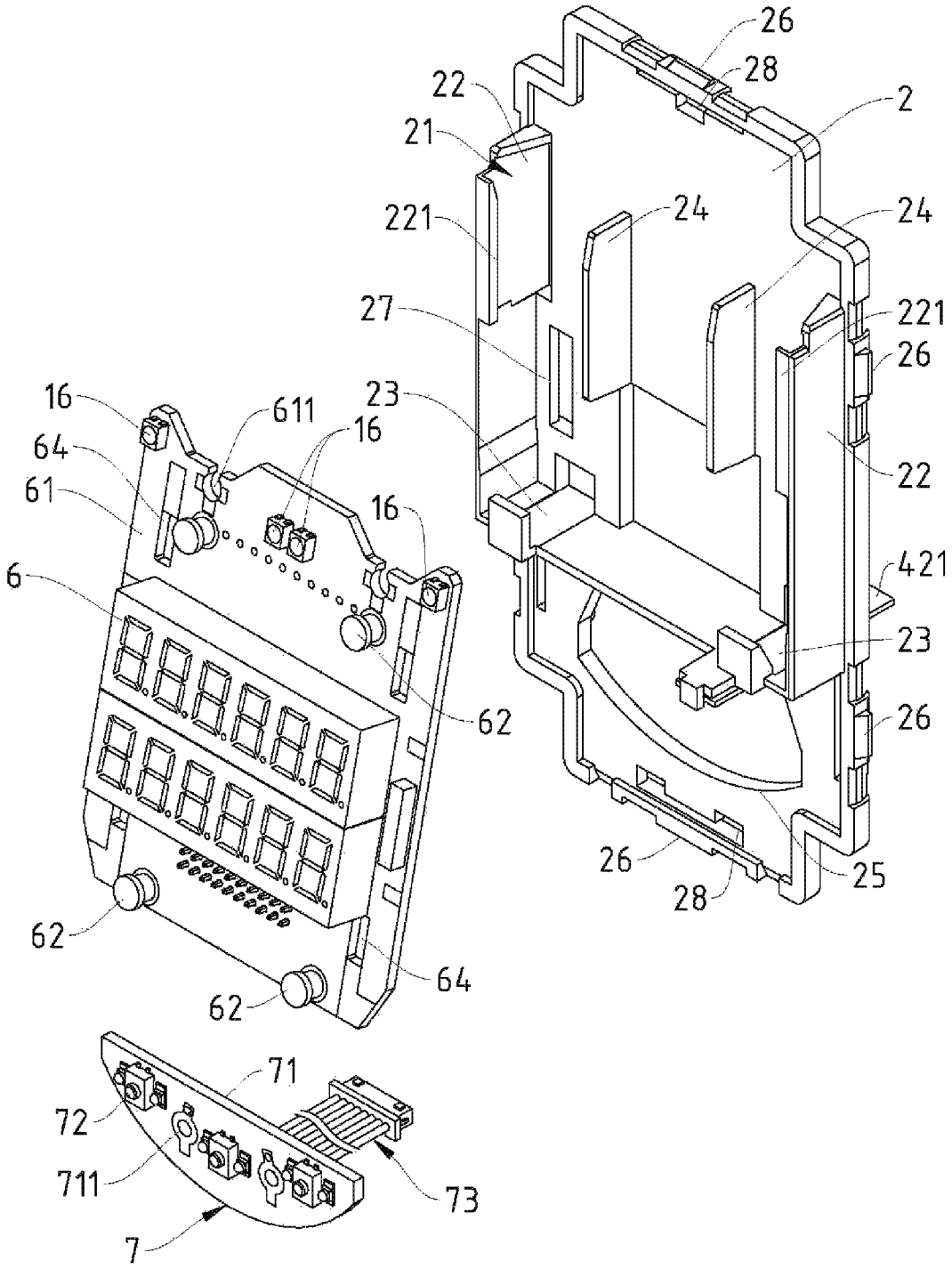
FIG. 6 is an exploded, perspective view illustrating the connection seat, the display, and the inputting device of FIG. 5.
Figure 7:
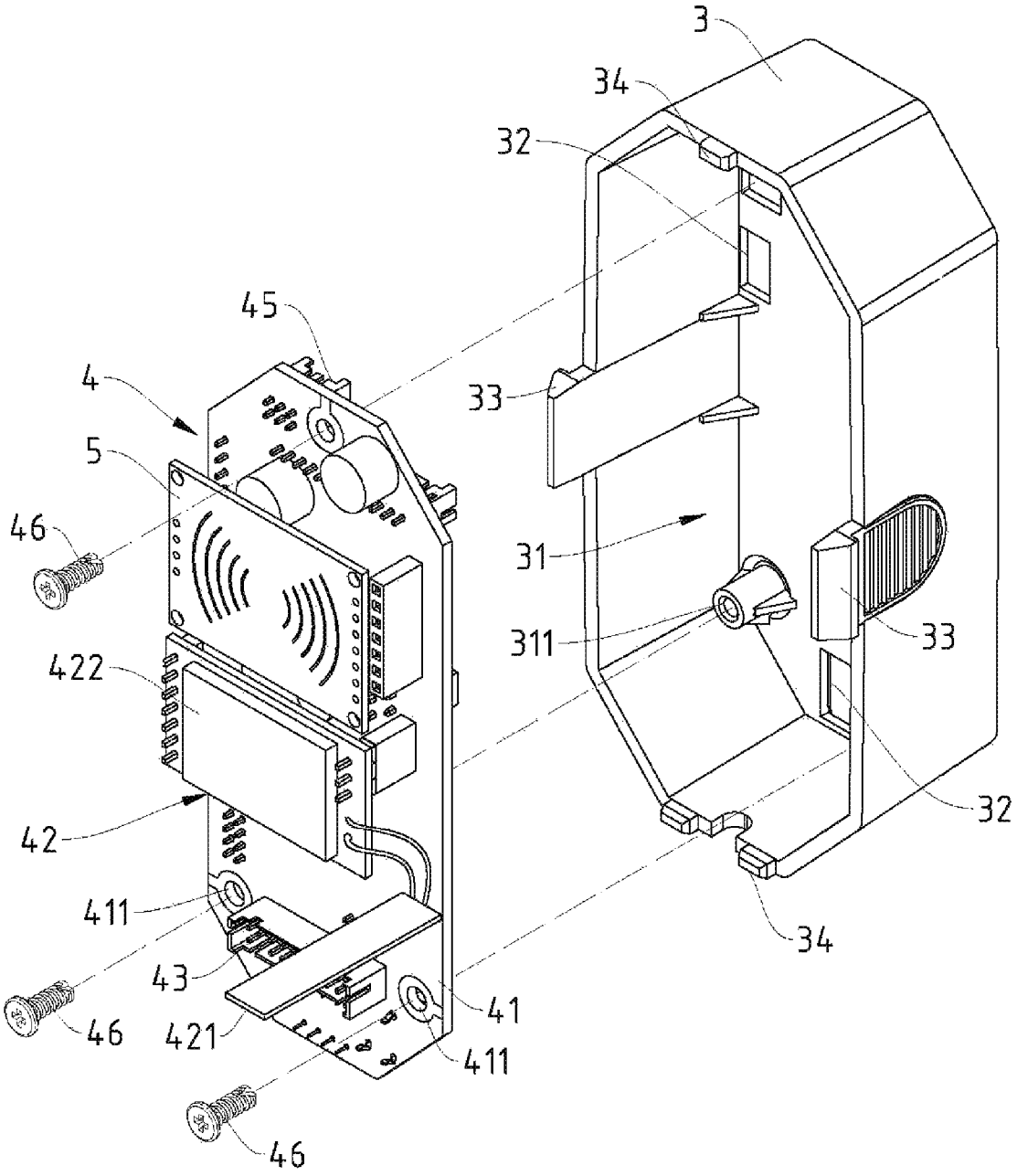
FIG. 7 is an exploded, perspective view illustrating a rear housing and a control device of the induction card managing device of FIG. 1.
Figure 8:
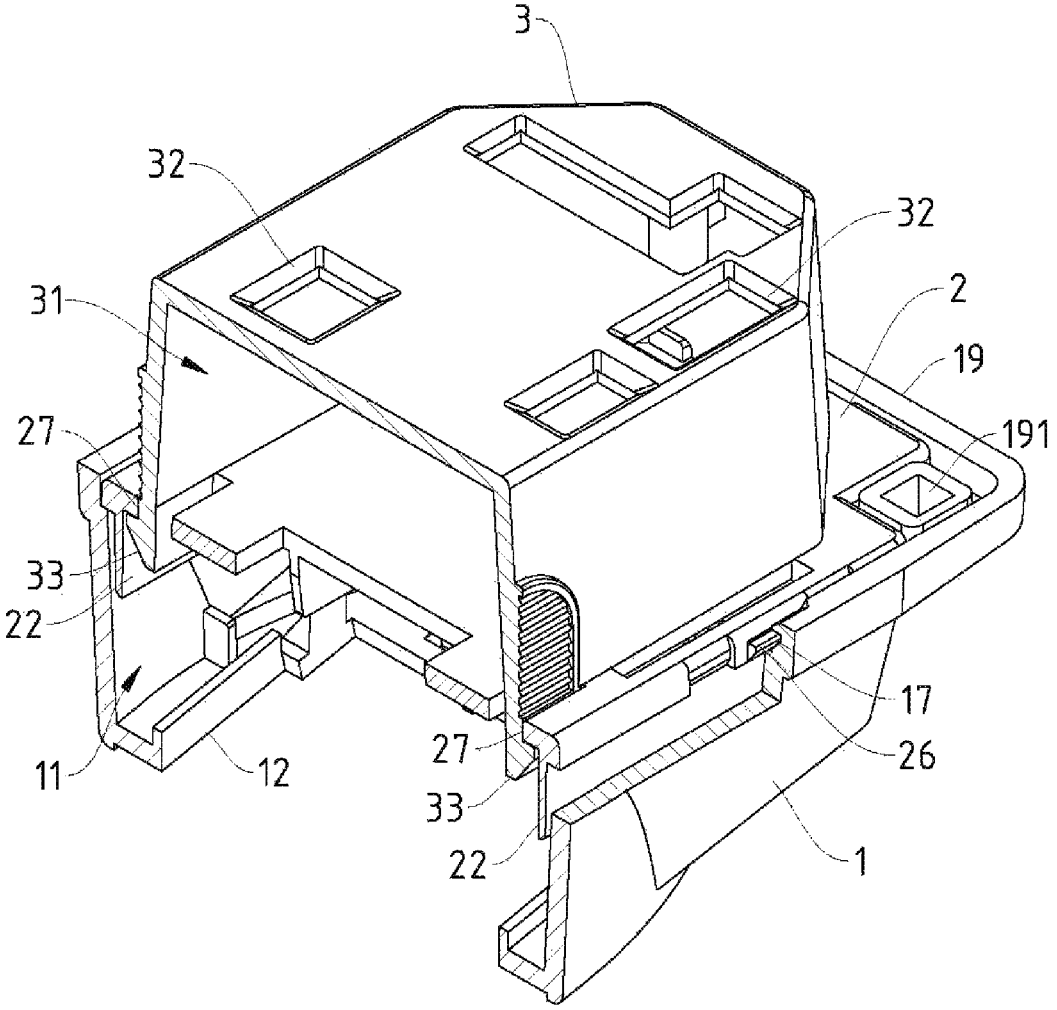
FIG. 8 is a partial, perspective of the induction card managing device of FIG. 1.
Figure 9:
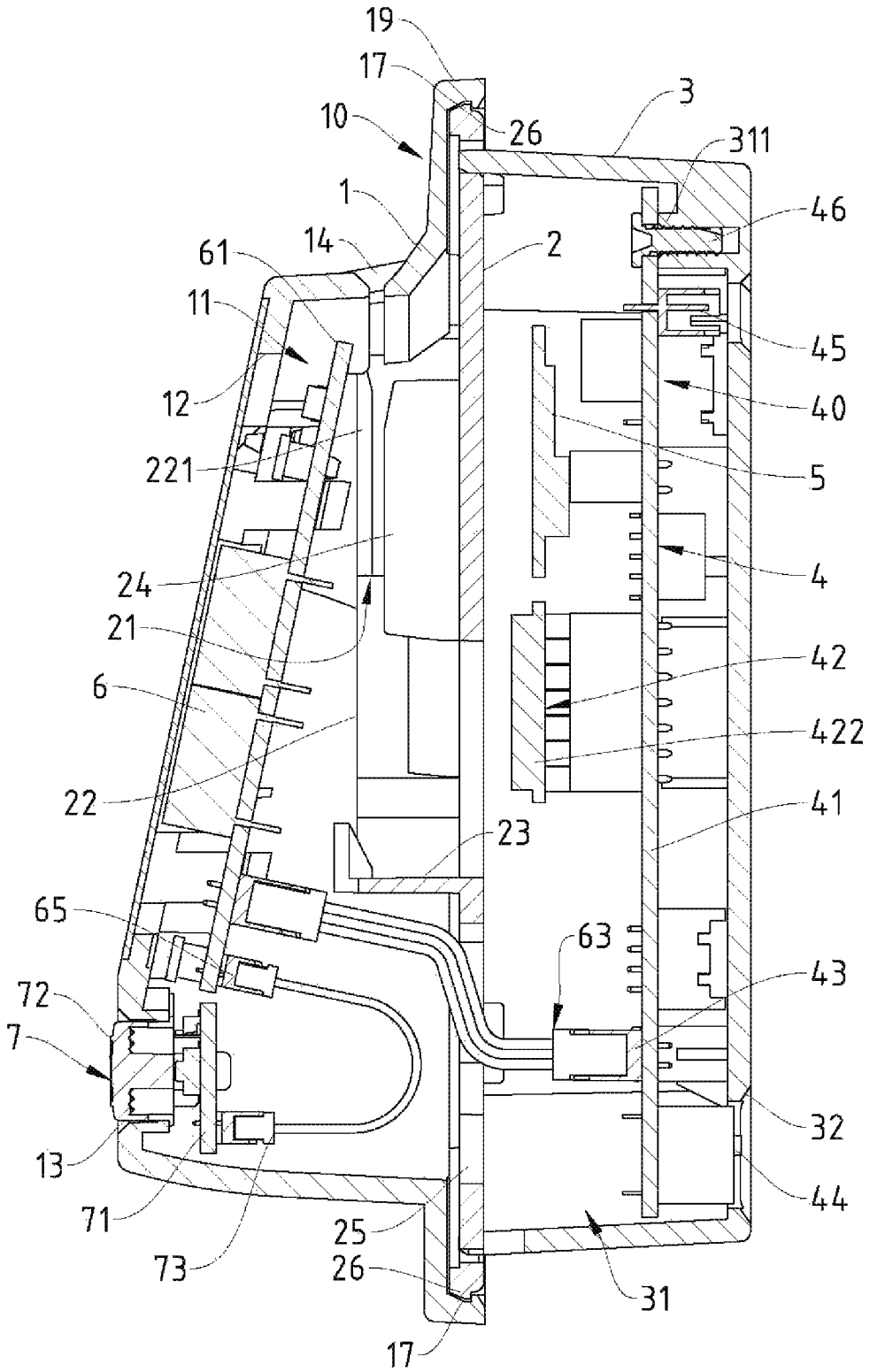
FIG. 9 is a cross sectional view of the induction card managing device of FIG. 1.

The display 6 and the inputting device 7 are located in the front chamber 11 and are received in the through-slot 12 and the plurality of openings 13, respectively. The display 6 can have a liquid crystal display module or a digital display module to show the credit value of the induction card A (see FIGS. 10 and 11) and the credit point for playing the gaming machine. The display 6 can show the error codes when errors occur. Furthermore, the display 6 can show information regarding rules for playing the game. The inputting device 7 can be used for selection and execution. The display 6 includes a display circuit board 61 having through-holes 611 for coupling with stubs 111 on the front casing 1. Furthermore, hooks 18 are provided on the front housing 1 for coupling with engaging holes 64 on the display circuit board 61, as shown in FIGS. 4-6.

The inputting device 7 includes an input circuit board 71 and a plurality of buttons 72 exposed via the plurality of openings 13 of the front housing 1. The input circuit board 71 is fixed by screws 74 extending through through-holes 711 into pegs 112 on the front housing 1, as shown in FIG. 5. A second connecting unit 73 is used to connect with a female connector 65 of the display 6. The display 6 is connected by a first connecting unit 63 to a female connector 43 of the controller 4. The sensor 5 is received in the rear chamber 31, extends uprightly, and is aligned with the card passage 21 of the connection seat 2. The sensor 5 is configured to proceed with reading/writing on the induction card A.

With reference to FIGS. 1, 2, and 9-11, in assembly, a coin receiver or a bill receiver of a gaming machine is removed, leaving an opening. Then, the annular fixing board 19 with the plurality of fixing holes 191 is used to fix the housing unit 10 to the opening resulting from removal of the coin receiver or bill receiver. The plurality of connectors 45 is connected to the gaming machine, and the setup device 44 can be used to set up programs to be executed by the controller 4 according to needs of the gaming machine.

In use, a user can insert an induction card A (such as a stored-value card) downwards through the card slot 14 into the card passage 21. The induction card A is positioned when stopped by the bottom plate 23. The sensor 5 is aligned with the card passage 21 and, thus, can proceed with reading/writing of the induction card A. After the induction card A is inserted into the card passage 21, the controller 4 displays the status (such as the balance) of the induction card A on the display 6 to inform the user. After the user knows the rules of playing the game by reducing the credit value of the induction card A, the gaming machine controls the controller 4 to reduce the credit value. Alternatively, the user can use the buttons 72 to reduce the credit value before playing the game. The wireless communication device 42 is wirelessly connected to a host computer (not shown) or the like, such that a manager or runner of the gaming machine can simply and rapidly know the status information of the induction card A.

When repair and maintenance of the controller 4 are required, the two second coupling members 33 of the rear housing 3 are disengaged from the two second engaging holes 27 of the connection seat 2, and the rear housing 3 is detached from the front housing 1 and the connection seat 2 to expose the controller 4 for repair and maintenance.

Although specific embodiments have been illustrated and described, numerous modifications and variations are still possible without departing from the scope of the invention. The scope of the invention is limited by the accompanying claims.

The invention claimed is:

1. An induction card managing device for a gaming machine, comprising:

a housing unit including a front housing, a connection seat, and a rear housing, wherein the front housing includes a front chamber having an opening facing rearwards, wherein the rear housing includes a rear chamber having an opening facing forwards, wherein the connection seat is coupled to the front housing, covers a rear side of the front chamber, and extends uprightly, wherein the rear housing is securely fixed to a rear side of the connection seat, wherein the front housing includes a front side having a through-slot and a plurality of openings, wherein the front housing includes a top side having a card slot, wherein the connection seat includes a front side having left and right portions, wherein two guiding plates respectively extend forwards from the left and right portions of the front side of the connection seat into the front chamber to form a card passage between the two guiding plates, wherein a bottom plate is disposed between the two guiding plates, and wherein an induction card is permitted to be inserted downwards through the card slot into the card passage and is stopped and positioned by the bottom plate; and a control device mounted in the housing unit, wherein the control device includes a controller, a sensor, a display, and an inputting device, wherein the sensor, the display, and the inputting device are electrically connected to the controller, wherein the display and the inputting device are located in the front chamber and are received in the through-slot and the plurality of openings, respectively, wherein the sensor is received in the rear chamber, extends uprightly, and is aligned with the card passage of the connection seat, and wherein the sensor is configured to proceed with reading/writing on the induction card.

2. The induction card managing device for the gaming machine as claimed in claim 1, wherein the controller includes a control circuit board securely mounted in the rear chamber of the rear housing and extending uprightly, wherein the sensor is mounted on an upper section of a front side of the control circuit board, wherein the control circuit board further includes a wireless communication device below the sensor, and wherein the wireless communication device is comprised of an antenna and an RFID integrated circuit.

3. The induction card managing device for the gaming machine as claimed in claim 2, wherein the connection seat includes a slot, and wherein the antenna extends forwards through the slot into the front chamber and is positioned in the slot.

4. The induction card managing device for the gaming machine as claimed in claim 2, wherein the controller further includes a setup device and a plurality of connectors, wherein the setup device and the plurality of connectors are disposed on a rear side of the control circuit board, wherein the rear housing includes a rear side having a plurality of through-holes, and wherein the setup device and the plurality of connectors are exposed via the plurality of through-holes of the rear housing.

5. The induction card managing device for the gaming machine as claimed in claim 1, wherein the front housing includes two light chambers on left and right sides of the card slot, respectively, and wherein two lighting elements are respectively received in the two light chambers.

6. The induction card managing device for the gaming machine as claimed in claim 1, wherein each of the two guiding plates includes a front end having an inner plate, wherein at least one front plate extends forwards from the front side of the connection seat, wherein the inner plates of the two guiding plates guide a front side of the induction card, and wherein the at least one front plate guides a rear side of the induction card.

7. The induction card managing device for the gaming machine as claimed in claim 1, wherein the housing unit further includes an annular fixing board on the rear side of the rear housing, and wherein the annular fixing board includes a plurality of fixing holes.

8. The induction card managing device for the gaming machine as claimed in claim 7, wherein the front housing, the connection seat, and the rear housing are coupled in sequence, wherein the front housing includes a plurality of first engaging holes disposed in a periphery of the rear side of the front housing, and wherein the connection seat includes a plurality of first coupling members coupled with the plurality of first engaging holes, respectively, securing the front housing and the connection seat together.

9. The induction card managing device for the gaming machine as claimed in claim 8, wherein the connection seat includes two second engaging holes on left and right portions of the rear side of the connection seat, respectively, wherein the rear housing includes two second coupling members on left and right sides thereof, and wherein the two second coupling members are coupled with the two second engaging holes to secure the rear housing and the connection seat together.

10. The induction card managing device for the gaming machine as claimed in claim 9, wherein the connection seat includes a plurality of recesses disposed on upper and lower ends of the rear side of the connection seat, wherein the rear housing includes a plurality of protrusions on upper and lower sides of the rear housing, and wherein the plurality of protrusions is coupled with the plurality of recesses to provide a positioning effect.

* * * * *